United States Patent [19]

Leber et al.

[11] Patent Number: 4,607,627

[45] Date of Patent: Aug. 26, 1986

[54] SOLENOID-ACTUATED HYGIENIC APPLIANCE

[75] Inventors: Leland C. Leber; David Swigert, both of Ft. Collins, Colo.

[73] Assignee: Teledyne Industries, Inc., Fort Collins, Colo.

[21] Appl. No.: 648,766

[22] Filed: Sep. 10, 1984

[51] Int. Cl.[4] ..... A61H 13/00; F04B 43/04

[52] U.S. Cl. ..... 128/66; 417/413

[58] Field of Search ..... 128/65, 66; 604/152, 604/153; 417/413, 414, 418

[56] References Cited

U.S. PATENT DOCUMENTS

| | | | |
|---|---|---|---|
| 1,822,242 | 9/1931 | Schöngut | 417/418 |
| 2,515,110 | 7/1950 | Bornstein | 417/418 |
| 2,898,860 | 8/1959 | Gröber | 417/413 |
| 2,930,324 | 3/1960 | Toulmin, Jr. | 417/413 |
| 3,015,835 | 1/1962 | Dyer et al. | 417/413 X |
| 3,089,425 | 5/1963 | Sprague et al. | 417/413 |
| 3,701,614 | 10/1972 | Guidicelli | 417/413 |
| 3,878,577 | 4/1975 | Jousson | 128/66 X |
| 4,143,998 | 3/1979 | O'Connor | 417/413 |
| 4,379,681 | 4/1983 | Goudy, Jr. | 417/413 X |

*Primary Examiner*—Robert P. Swiatek
*Attorney, Agent, or Firm*—Hugh H. Drake

[57] ABSTRACT

An oral hygiene appliance combination has a housing into which liquid is fed and from which liquid is delivered into the mouth of the user. A pump within the housing is of a solenoid-actuated type and includes a chamber that inlets and outlets the liquid to be applied under the pumping action. A flexible diaphram, which effectively forms part of the chamber, sustains the pumping action. Movement of that diaphram is coupled to movement of the solenoid plunger. At least one solenoid winding is cyclically energized to move the plunger and the diaphram in connection with the pumping action.

20 Claims, 18 Drawing Figures

SOLENOID-ACTUATED HYGIENIC APPLIANCE

The present invention pertains to oral hygiene appliances that enable treatment of the teeth and gums of the user as well as to a pumping unit that enables proper performance of that kind of apparatus. It also relates to various and sundry modifications of the basic approach that enable enhanced performance or structural variation.

Oral irrigating apparatus has received widespread attention and substantial commercial success over a period of about the last twenty years. In a leading approach, pulses of water or other liquid are directed into the mouth by the user for the purpose of cleaning the teeth and massaging the gums. In order to optimize performance, pulse jet characteristics and other mechanical factors preferably are carefully selected in light of several human factors. Further background information in this respect is found in U.S. Pat. No. 3,227,158—Mattingly.

Over the intervening years, a number of apparatus variations have been devised, and many of those already have issued as patents. Examples are U.S. Pat. Nos. Re. 27,274, 3,453,969, 3,467,083, 3,425,410 and 4,094,311. While there has been at least one suggestion to develop the water pulses by means of an interrupting-type turbine assembly driven directly by water delivered from a faucet, the dominant approach has been to produce the pulses in a pump which is driven by an electric motor. Typically, the water is drawn from a reservoir into the pump and then delivered therefrom through a flexible hose into a hand-held nozzle. Usually, a control is provided for adjusting the pressure developed in the delivered pulses.

Rotary electric motors to drive the pump appear to have found favor because they may be fairly small, are not exceedingly expensive and have proved to be highly reliable in this kind of usage. At the same time, the associated pumps have been improved in terms of miniaturization, reliability and cost. Indeed, at least one such pump has been produced which is molded entirely from plastics.

Nevertheless, the motor and pump assembly have continued to be a significant proportion of the overall manufacturing cost in terms of both labor and materials. Moreover, the need to physically accommodate the motor and pump assembly within the housing or cabinet of the appliances has placed a limit upon the degree of minimization in size of the overall unit, often has resulted in correlated waste of space in the interior of the housing and, in an effort to design housings that have attractive external appearances, has led to a somewhat uniform box-like shape. In addition, the use of an economical electric motor has not accomodated substitution of inexpensive electronic controls for what up to now have been at least primarily mechanical controls on the various characteristics of operation.

While the emphasis herein is in connection with oral hygiene devices, it is to be noted that the same apparatus also has found usage in other implementations such as wound debridement, cleaning of openings such as the ear canal and other medical applications.

In fields other than oral hygiene, the pumping of a liquid is, of couse, often accomplished, and the kind of pumping apparatus involved has varied widely. One known kind of pumping apparatus includes the use of a solenoid. A plunger is caused to reciprocate by at least one solenoid winding which is periodically energized. The return stroke of the plunger typically is caused to occur either by means of a spring or by the use of a second solenoid winding. Representative of those approaches are the disclosures in U.S. Pat. Nos. 2,925,814, 3,134,938, 3,162,134, 3,282,220, 3,422,765, 3,468,257, 3,592,565, 3,603,706, 3,620,650, 3,740,171, 3,754,154, 3,836,289, 3,894,817, 3,910,729, 4,047,852 and 4,102,610.

Notwithstanding that substantial degree of development with respect to solenoid-actuated pumps, that approach, so far as is known, has not heretofore found utility in oral hygiene appliances. Analysis reveals that this probably is due to the fact that it has not been economically feasible, at least in a comparatively compact assembly, to incorporate such an approach while yet achieving desired pulse characteristics such as those described in the aforesaid Mattingly patent.

It is, accordingly, a general object of the present invention to provide a hygienic appliance that overcomes deficiencies and difficulties present for this utility in prior apparatus such as that herein above mentioned.

Another object of the present invention is to provide a hygienic appliance which has a distinct cost advantage over currently-used rotary electric motors.

A further object of the present invention is to provide a hygienic appliance which includes a pump assembly that is more compact and, thus, better lends itself to different housing designs for allowing flexibility in industrial design and also allowing additional space for the accommodation of other devices.

Still another object of the present invention is to provide a hygienic appliance of the kind described which readily permits the adaptation of a number of features such as pulse rate control, pressure control, automatic adjustment for supplied voltage or frequency and selected parameter readout for the user.

A specific object of the present invention is to provide a hygienic appliance that not only satisfies the foregoing objectives but also is capable of achieving the optimum in liquid pulse characteristics.

An overall objective also is to provide a hygienic appliance which is readily adaptable to mass production and requires the use of only readily available materials.

In accordance with one aspect of the present invention, a hygienic appliance combination has a housing associated with a source of liquid and delivery means coupled to the housing for launching pulses of the liquid toward an impact point. A pump located within the housing is coupled to accept the liquid and provide pulses of the liquid into the delivery means. Included in the pump are enveloping means that define an elongated central bore of predetermined length together with at least one solenoid winding positioned to deliver magnetic flux into the interior of the bore. A plunger of magnetic material is sized to slide within the bore and is of a length less than that predetermined length. Defined in the pump is a chamber along with means for inletting liquid from the source into the chamber and means for outletting liquid therefrom into the delivery means. Check valve means is effectively disposed in the path of flow of the liquid to permit such flow at least primarily in the direction from the source, through the chamber and out of the delivery means. Reciprocating means coupled into the chamber alternately effects the drawing of the liquid into the chamber and the propelling of the liquid therefrom through the outletting means into the delivery means. Movement of that reciprocating means is slaved to movement of the plunger. Also included are means for cyclically energizing that one winding to move the plunger and the reciprocating means each in a given direction. Finally, there are means for urging the plunger and the reciprocating means each in a return direction opposite the aforesaid given direction.

In a preferred approach, the elongated bore of predetermined length is defined within a shell. An effective pair of solenoid windings are each positioned to deliver magnetic flux into the bore interior and there are means for energizing individual ones of those windings alternately to induce movement of the plunger in reciprocation. Also defined within the shell is a second bore, and a piston is sealingly disposed within that second bore for movement slidingly therein. The piston is coupled for movement in slaved relationship to the plunger. Still further, a chamber is effectively defined in the shell and it includes means for inletting the liquid into the chamber and means for outletting that liquid therefrom.

Besides check valve means for permitting operational one-way directional flow, a diaphram preferably defines a portion of the boundary of the chamber, with flexure of the diaphram in alternate directions pumping the liquid through the chamber. Further defined within the shell is a cavity into which the piston projects as a portion of the wall thereof, with the diaphram forming another portion of that wall. A fluid contained within the cavity couples movement of the piston in slaving relationship to effect flexure of the diaphram.

The features of the present invention which are believed to be patentable are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which:

Figure 6:
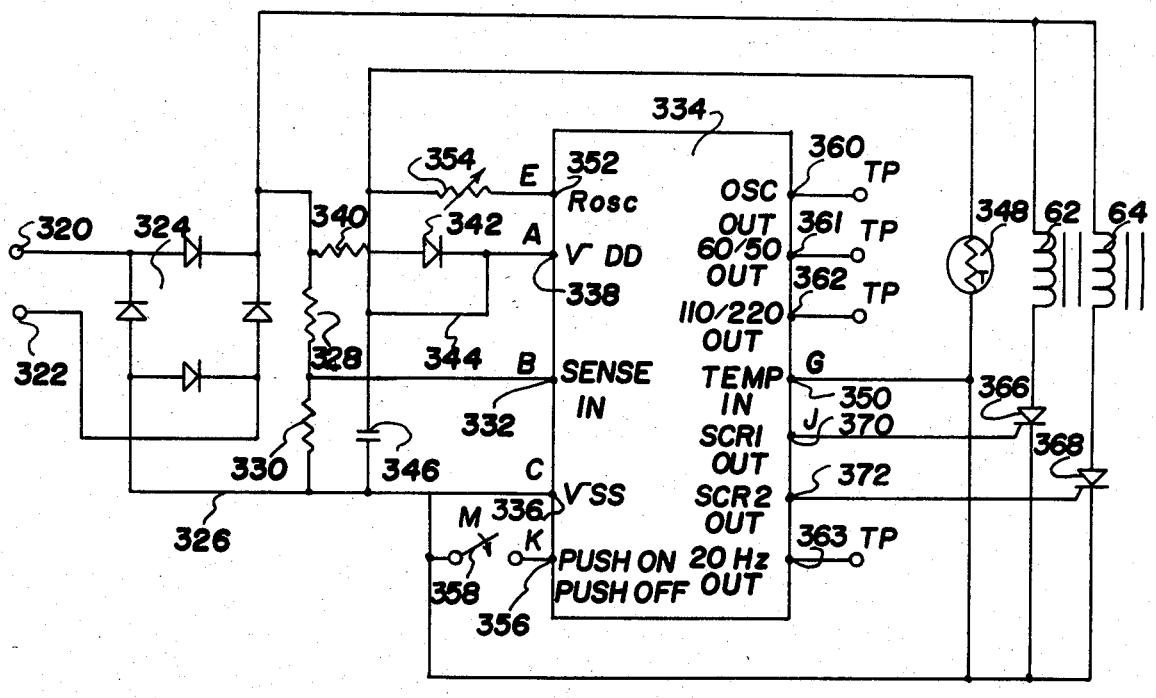
FIG. 6 is a schematic view of circuitry alternative to that of FIG. 4.
Figure 6A:
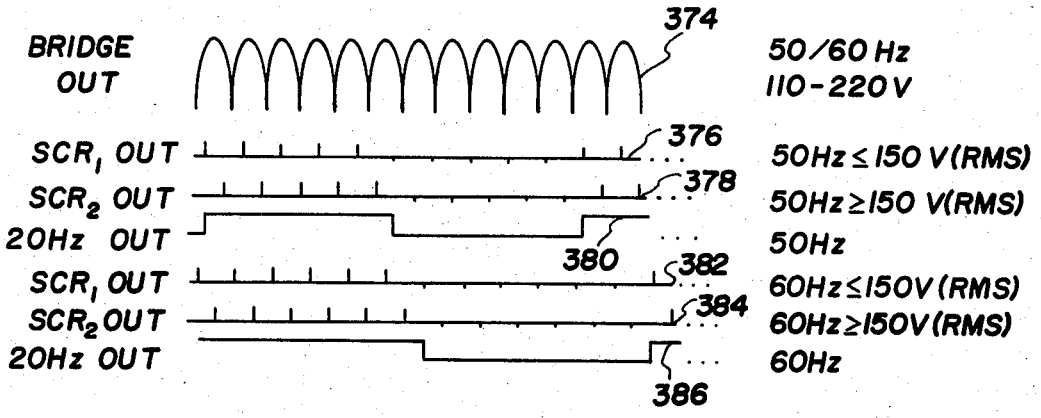

FIG. 6*a* is a timing diagram for operation of the circuitry depicted in FIG. 6.

Figure 5:
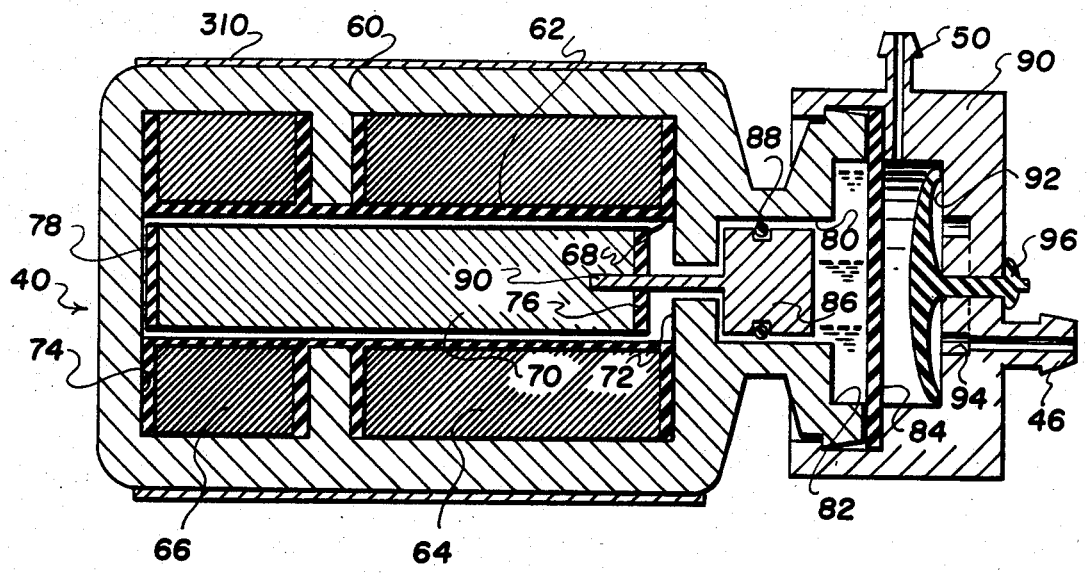
FIG. 5 is an enlarged cross-sectional view of a component shown in FIGS. 1–3.
Figure 7:
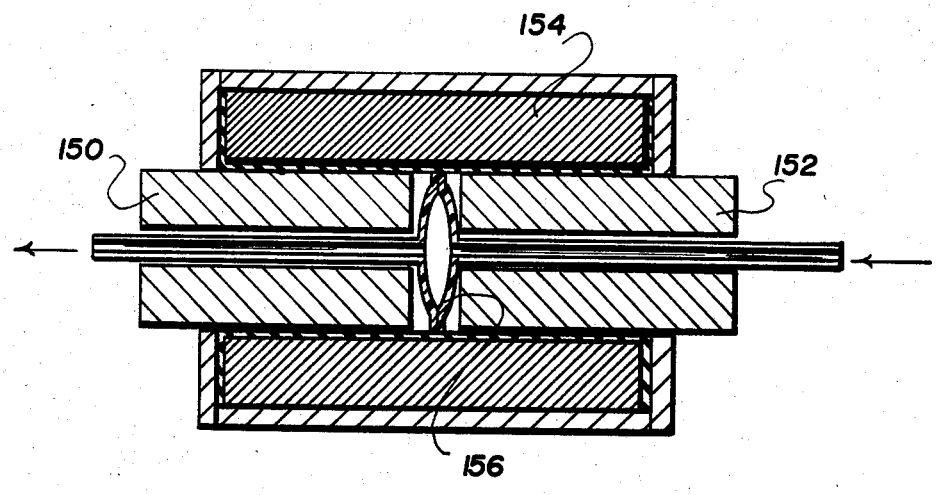
Figure 8:
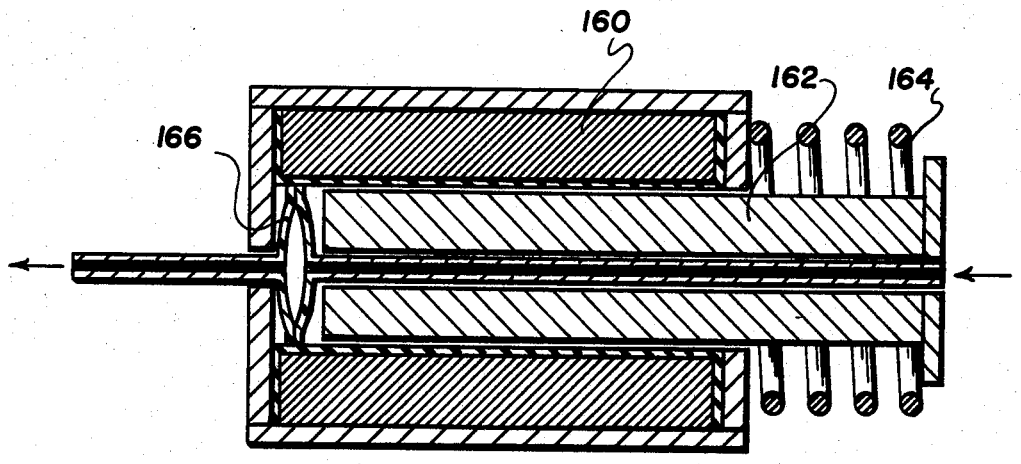
Figure 9:
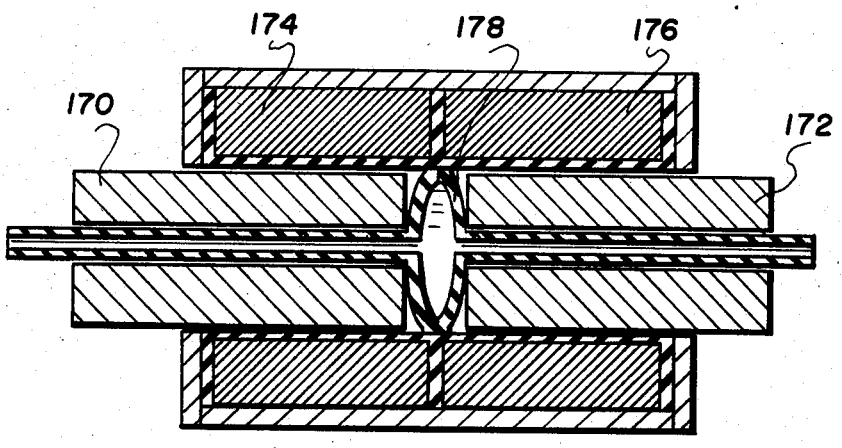
Figure 10:
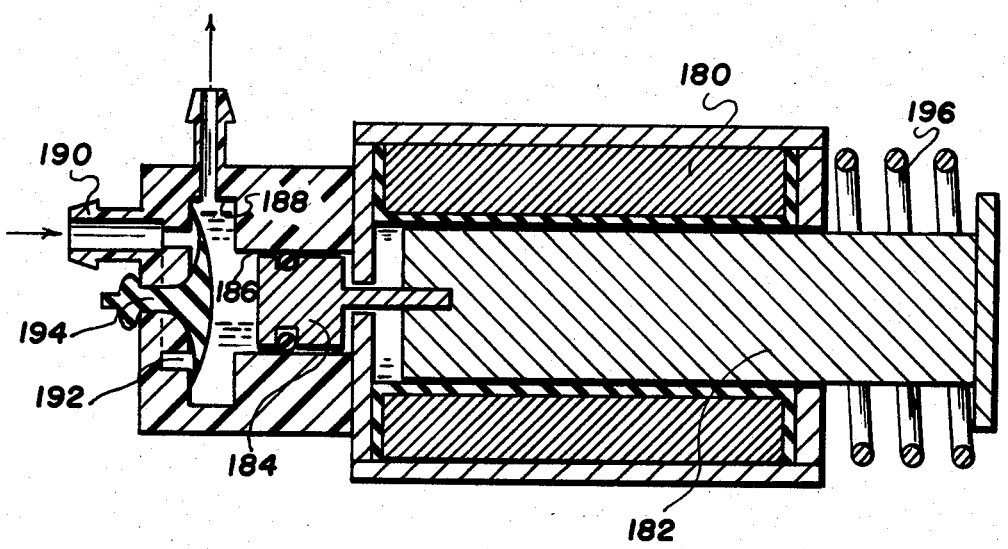
Figure 11:
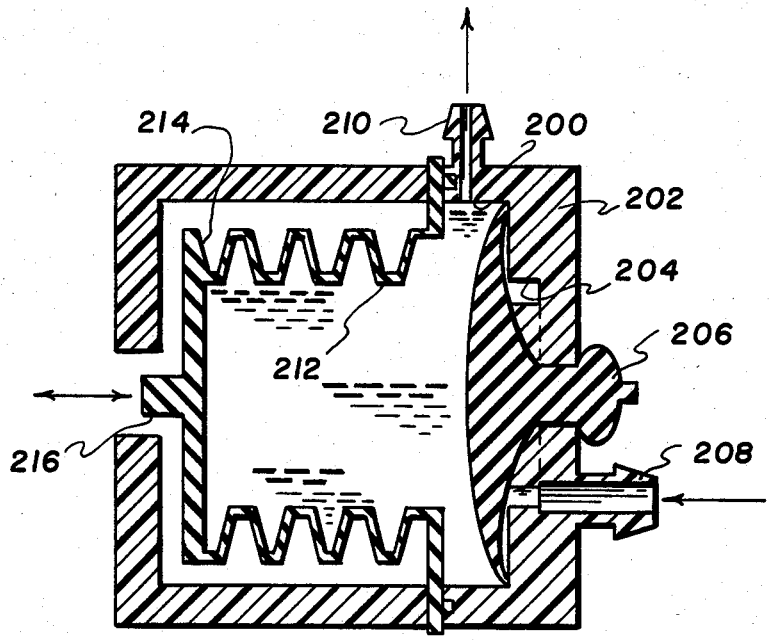
Figure 12:
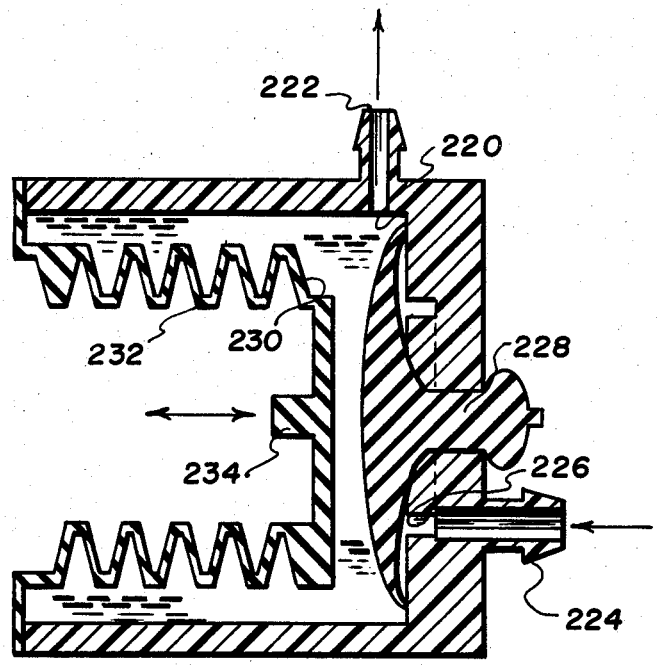
Figure 13:
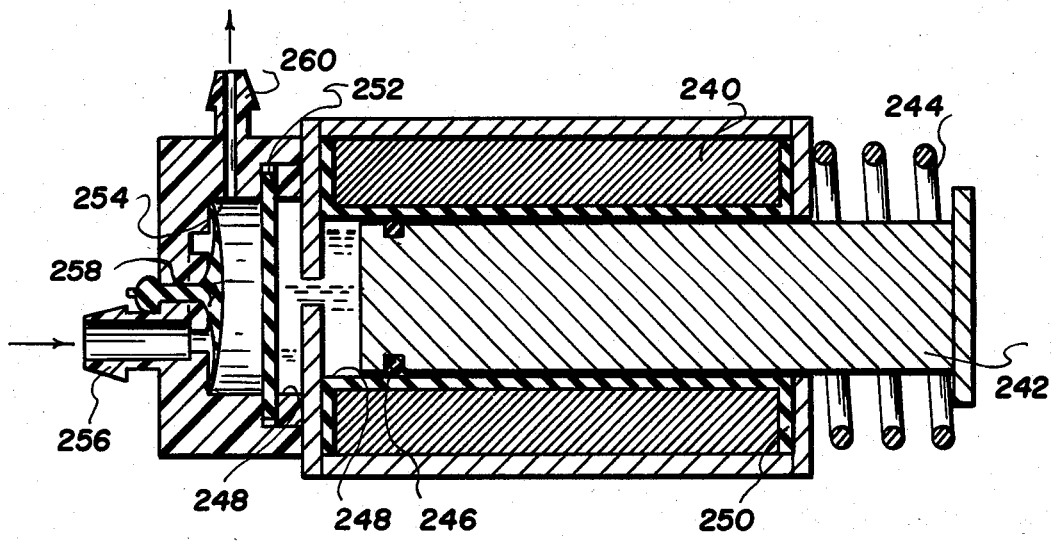
Figure 14:
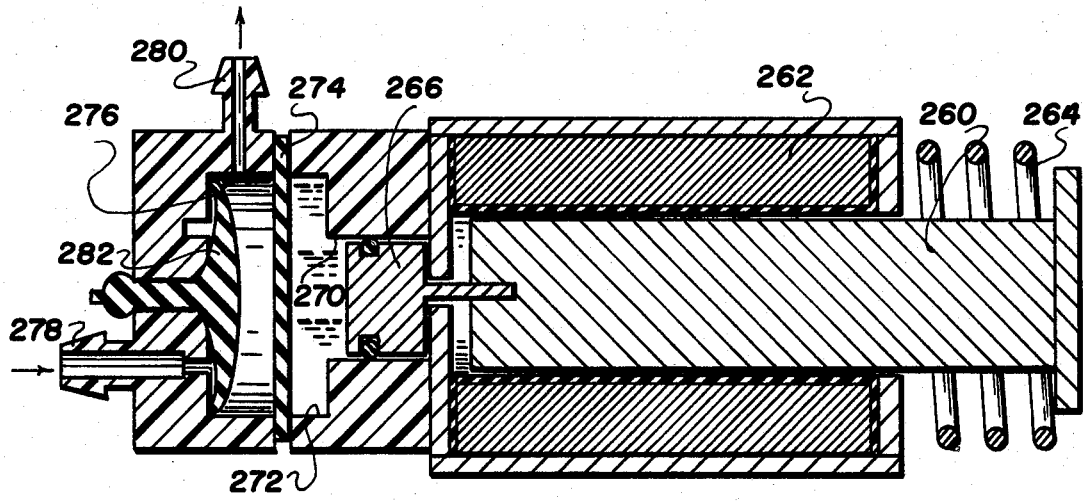
Figure 15A:
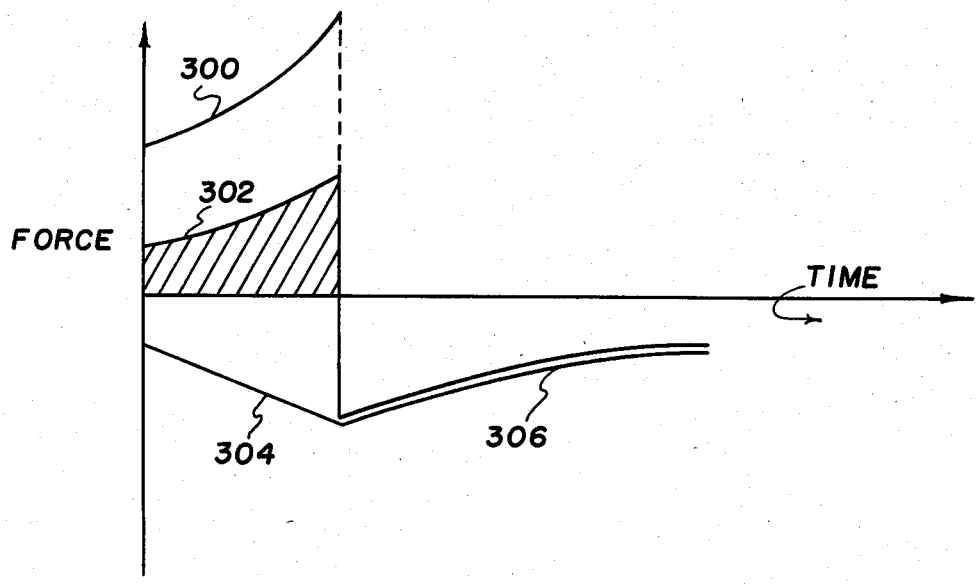
Figure 15B:
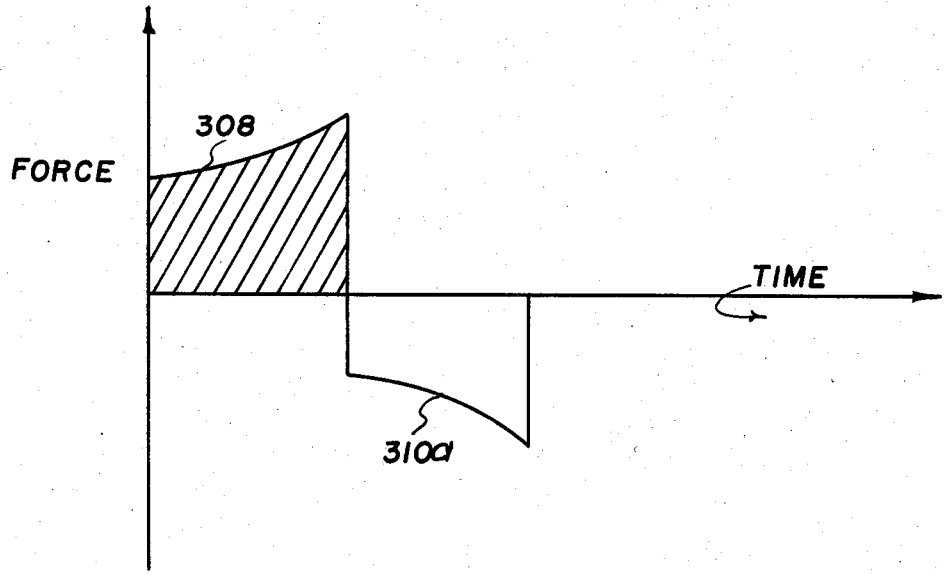
Figure 16:
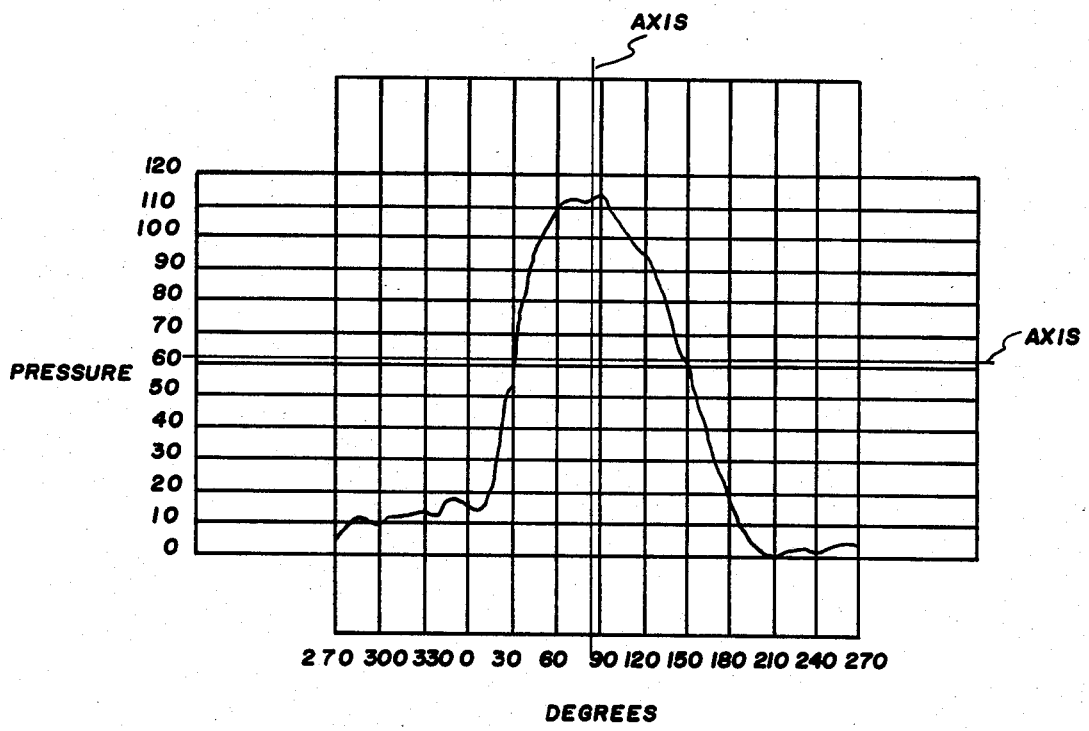

FIG. 7 is a diagrammatic view of an alternative to a component of FIG. 5;

FIG. 8 is a diagram of another such alternative;

FIG. 9 depicts still another alternative;

FIG. 10 similarly depicts a diagram of yet a different alternative for a pumping assembly;

FIG. 11 illustrates a still further alternative for the pumping assembly;

FIG. 12 similarly illustrates a modified version of that which is shown in FIG. 11;

FIG. 13 in a similar manner represents a yet further alternative;

FIG. 14 in the same manner represents one more alternative;

FIGS. 15*a* and 15*b* depict force diagrams applicable to the foregoing apparatus; and FIG. 16 is a graph depicting a preferred relationship between pressure and time as measured at the exit of an included pump.

Figure 1:
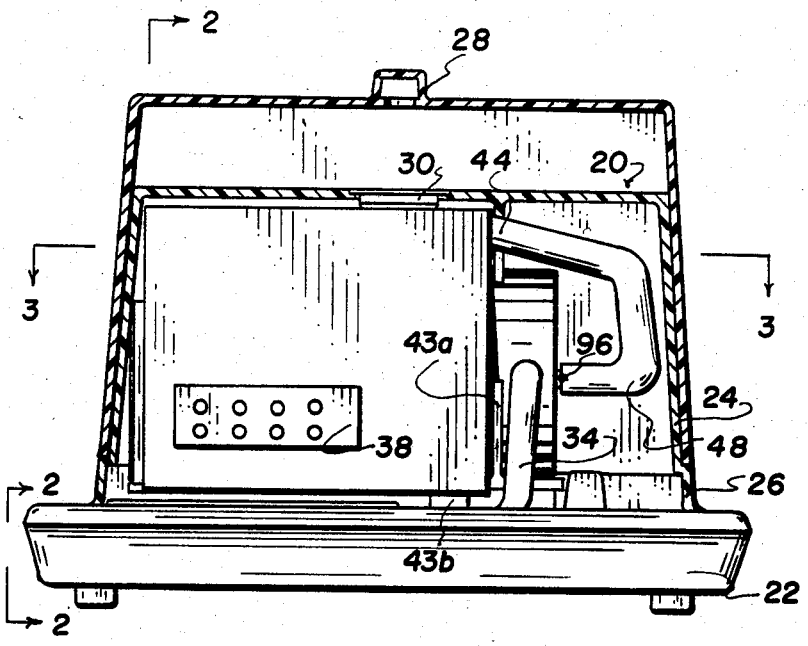
FIG. 1 is a front elevational view, partially broken away, of an oral hygiene appliance having its parts arranged in a storage condition.
Figure 2:
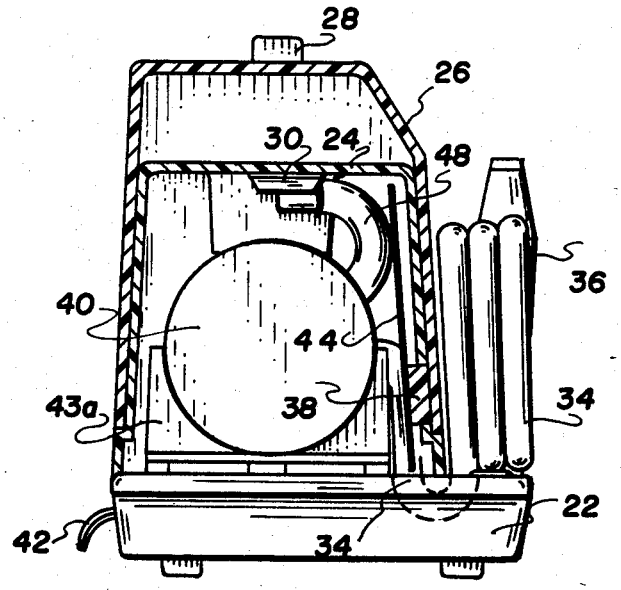
FIG. 2 is a cross-sectional view taken along the line 2—2 in FIG. 1.
Figure 3:
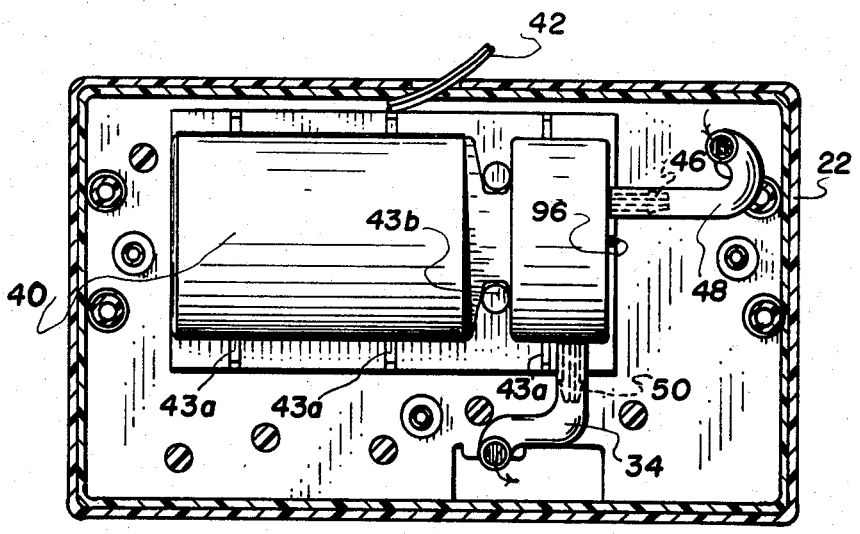
FIG. 3 is a cross-sectional view taken along the line 3—3 in FIG. 1 but with certain components removed.

As shown in FIGS. 1–3, an oral hygiene device has a housing or enclosure 20 which includes a base unit 22 from which upwardly projects the body 24 of the housing. Around its lower margin, body 24 is slightly inset so as to receive the wall of a cover 26 in an approach such that, with cover 26 in place, a generally smooth-walled exterior appearance of the entire appliance results.

Centrally located in the top wall of cover 26, in its orientation as shown in FIG. 1, is a valve 28 mateable with an inlet coupling 30 when cover 26 is inverted and disposed atop the housing to serve as a liquid reservoir. Details of one form of such a coupling are shown in the aforesaid U.S. Pat. No. 4,094,311.

Formed on the front portion of base 22 is a ledge of sufficient size to accommodate a coiled flexible hose 34 connected at its outer end into a nozzle handle 36 which may be seated within an opening provided in the ledge on base 22. Body 24 has a front wall in which is mounted a panel 38 which carries a plurality of touch-buttons as shown which allow user control and operation.

Within the interior of housing 24 is a pumping assembly 40 energized from a power cord 42 through action of one or more of the touch-buttons in panel 38. Assembly 40 is mounted upon saddles 43*a* and 43*b* that project upwardly from the floor of the housing. As shown in FIG. 3, various openings accomodate assembly of body 24 to base 22 by means of screws. Also included within the interior of body 24 is a printed circuit board 44 which contains electronic circuitry yet to be described but which is under the control of the touch-buttons in panel 38. Pumping assembly 40 includes an inlet fitting 46 coupled by a hose 48 to coupling 30, and an outlet fitting 50 is coupled to hose 34. In use, a jet tip or nozzle is plugged into the outer end of handle 36 as shown in a number of the aforementioned prior patents, including U.S. Pat. No. 4,094,311. The jet tip preferably includes an outer end portion bent laterally so that an outlet orifice is capable of projecting fluid laterally to the axis of handle 36.

In operation, water from the reservoir formed by inverted cover 26 is drawn therefrom by pumping assembly 40 through valve 28 and delivered by way of hose 34 to the jet tip. The water emerges from the orifice in a series of pulses or slugs. The ultimately produced water pressure, flow rate, pulse rate and orifice diameter all preferably are within the ranges taught by the aforesaid Mattingly patent. The overall mechanical functions of each of the different principal components are the same as those described with respect to the apparatus of the aforesaid U.S. Pat. Nos. Re. 27,274 and 4,094,311. Accordingly, the teachings of those two patents are incorporated herein by reference.

As best seen in FIG. 5, pumping assembly 40 is in the form of an elongated cylindrical shell 60 formed of low-reluctance magnetic material. Mounted within the interior of shell 60 is a dual bobbin 62 on which are wound first and second solenoid windings 64 and 66. Defined within the interior of bobbin 62, and thus within the interior of shell 60, is a bore 68 within which a plunger 70 of magnetic material is slidably received. Plunger 70 is of a length less than the length of bore 68 so as to be capable of moving back and forth longitudinally within the bore. However, the degree of that movement is limited by the opposing end walls 72 and 74 of shell 60. Preferably, resilient bumpers 76 and 78 are affixed to the respective opposing ends of plunger 70.

Defined in shell 60, in a location spaced beyond cavity 68 from the end of plunger 70 which in this case carries bumper 76, is a second bore 80. Bore 80 opens into a cavity 82 also formed in shell 60 and closed along one wall portion opposite bore 80 by a flexible diaphram 84.

Slidable within bore 80 is a piston 86 sealed therein by an O-ring 88. Projecting from piston 88 is a stem 90 that is staked or otherwise rigidly secured into plunger 70. Cavity 82 is filled with a somewhat viscous fluid. As a result, reciprocation of piston 86 by means of reciprocation of plunger 70 serves to flex diaphram 84 back and forth in a direction perpendicular to its major plane.

Secured to the end of shell 60 and generally beyond diaphram 84 is a bonnet 90 in which inlet and outlet fittings 46 and 50 are formed. Defined within bonnet 90 is an interior chamber 92 one portion of the boundary of which is defined by diaphram 84. Inlet nipple 46 leads into a plenum 94 over which is disposed a resilient umbrella valve 96 the active portion of which is disposed within chamber 92 and which has a stem secured in the wall of bonnet 90 opposite diaphram 84.

Figure 4:
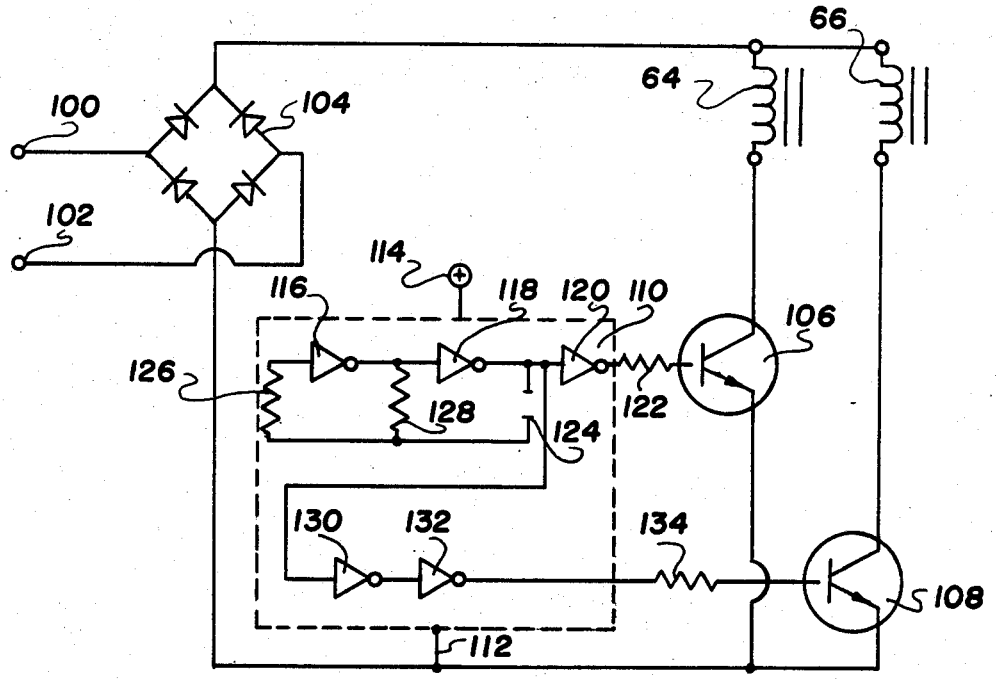
FIG. 4 is a schematic diagram of circuitry included within the appliance of FIG. 1.

The circuitry necessary to operate pumping assembly 40 may be exceedingly simple as exemplified in FIG. 4. An alternating current source, as from a conventional wall outlet, is connected through power cord 42 to terminals 100 and 102 and led to the input of a bridge rectifier 104 the direct current output of which is connected from one side to one end of each of windings 64 and 66. As indicated, the other end of winding 64 is returned to the other side of rectifier 104 through the collector-emitter path of a transistor 106. Similarly, the other end of winding 66 is returned to the other side of rectifier 104 through the collector-emitter path of a transistor 108.

Rectifier 104 and transistors 106 and 108 are, in this case, mounted on circuit board 44 along with an oscillator-driver chip 110 which may be, for example, a CD4049. Chip 110 is powered by a connection at 112 to the negative side of the circuitry and a connection at 114 to a suitable source of positive voltage which may be derived by way of a voltage divider from rectifier 104. Included within chip 110 are a succession of Nor gates 116, 118 and 120 with the output of the latter being fed through a resistor 122 to the base of transistor 106. In a conventional manner, as such, the output of Nor gate 118 is coupled back through a capacitor 124 and a resistor 126 to the input of gate 116, a resistor 128 shunting the output of gate 116 to the junction between capacitor 124 and resistor 128. Capacitor 124 together with resistors 126 and 128 serve to cause the illustrated circuitry to oscillate, in this case at a frequency of 20 Hz. Also coupled to the output of gate 118 is a series of Nor gates 130 and 132 in turn feeding the base of transistor 108 through a resistor 134.

In a general overall view of operation, the circuitry of FIG. 4 serves to alternately activate transistors 106 and 108 into conduction. That is, winding 64 is first energized after which winding 66 is energized. When winding 66 is energized, plunger 70 is drawn to the left as shown in FIG. 5. In turn, that draws piston 86 to the left and, through fluid coupling in cavity 80, also causes diaphram 84 to flex in the leftward direction. Such movement of those components serves to open valve 96 and draw liquid through fitting 46 into chamber 92. Thereafter, coil 66 is de-energized and the circuitry drives transistor 106 into conduction so that winding 64 is energized and drives plunger 70 back to the right in FIG. 5. In turn, that moves piston 86 also to the right and, again through fluid coupling, causes diaphram 84 to flex rightwardly and force the liquid out of chamber 92 through fitting 50.

When diaphram 84 flexes to the right in FIG. 5, umbrella valve 96 closes over plenum 94 and prohibits passage of any of the liquid backwardly out of fitting 46. An analogous check valve might be included in connection with outlet fitting 50 and the hose leading away therefrom. In this environment, however, that is unnecessary because hose 34 is sufficiently flexible to close upon itself upon each "return" stroke of plunger 70 and the slaved components. In any case, the successive reciprocations of plunger 70 under the controlled actuation provided by the circuitry of FIG. 4 serve to create a pumping action that alternately draws the liquid into chamber 92 and then forces it out of that chamber into the delivery components.

For reasons yet to be explained, the pump and solenoid embodiment of FIG. 5 represent the preferred approach. Nevertheless, other alternative structures may be incorporated. FIG. 7 illustrates what might be called a dual plunger activator. In it, plungers 150 and 152 slide within a single coil 154 and sandwich a hollow diaphram 156 which, when the energization to coil 154 is removed, serves to return the plungers to their rest positions and, at the same time, create the force necessary for suction at the inlet. Being in tandem, plungers 150 and 152 both take on the polarity of the field induced by coil 154, thereby exhibiting opposite poles at the region of their mutual interfacing. An advantage of this approach is that the liquid flow is enabled to traverse the interior of plungers 150 and 152, thereby lending the assemblage to compact formation. Nevertheless, careful attention has to be given to the avoidance of fatigue in the materials from which diaphram 156 is constructed, and overall economy is somewhat difficult to achieve if sufficiently high flow rates of the pump's liquid are to be obtained.

Another single-coil version is illustrated in FIG. 8. In this case, a single coil 160 surrounds a single plunger 162 biased for a return stroke by a compression spring 164. Again, flow is interiorly of the unit and a bonded diaphram 166 is employed. The use of spring 164 relieves hollow diaphram 166 from having to contribute to the work of returning the plunger to its withdrawn position.

Sort of a hybrid of that shown in FIGS. 5, 7 and 8 is illustrated in FIG. 9. In this case, a pair of plungers 170 and 172 are disposed interiorly within respective windings 174 and 176. Once more, a common interior passage from inlet to outlet leads through a hollow bonded diaphram 178 of a polymer or the like. By placing plungers 170 and 172 in tandem, they attract when the fields developed are of the same polarity and repel when they are of opposite polarity. One of the windings has a fixed polarity applied to it, while the other has a square wave applied. Alternatively, windings 174 and 176 may be operated by a circuit analogous to that shown in FIG. 4. In any case, careful attention must be given to the structure of diaphram 178 in order to avoid fatigue, and attention also must be given to the achievement of adequate flow rates while avoiding the need for large coil assemblies and other increased manufacturing costs.

Related both to FIGS. 8 and 5 is the embodiment of FIG. 10. There is a single solenoid winding 180 surrounding a single plunger 182 which drives a piston 184 sealingly movable within a bore 186 that opens into a pumping chamber 188. An inlet fitting 190 leads into a plenum 192 which communicates with chamber 188 through an umbrella-type check valve 194. Having only a single solenoid winding 180, a return spring 196 serves to withdraw piston 184 away from chamber 188 upon each successive de-energization of solenoid winding 180. An advantage of this approach, as in the approach of FIG. 5, is that the physical size of the enerigizing winding, or windings, is not dictated by the necessary size of the pump in order to achieve adequate flow rates.

In substitution for either a piston or hollow diaphram type of approach as earlier discussed, the pumping assembly of FIG. 11 may be substituted. Basically, a pumped-liquid-containing chamber 200 is defined in a housing 202 which also includes the definition of a plenum chamber 204 covered by an umbrella check valve 206 as before and into which is fed the liquid to be be pumped through an inlet fitting 208. The exhaust is by way of an outlet fitting 210. Chamber 200 is shaped to define a threaded or corrugated wall 212. Cooperating therewith and correspondingly related is a likewise threaded bellows or spirophragm 214 driven as at 216 by a plunger defined by any of the preceding embodiments.

A reverse mode of implementation is shown in FIG. 12 wherein the liquid being pumped is on the outside of the "spirophragm" pump assembly. In this case, a pumping chamber 220 has an outlet 222 and an inlet 224 which feeds a plenum chamber 226 covered by an umbrella valve 228. In speaking of umbrella valves, it should be noted at this point that they are the presently preferred mode of inlet check valving. Clearly, other check valves, such as of the ball type, may be substituted. In any case, the fluid is inletted into chamber 220 around a convoluting threaded structure 230 within which is an expandable and spirally corrugated bellows 232 driven through a stem 234 from a solenoid plunger. In the versions of both FIGS. 11 and 12, attention should be given to the sizing and detailed shaping of the spherical bellows "grooves" in order to avoid the trapping of air that otherwise will reduce pump pressure.

A further approach is illustrated in FIG. 13. In this case, a single solenoid 240 surrounds a plunger 242, and a return compression spring 244 is biased between the housing for winding 240 and the end of plunger 242. In this case, plunger 242 serves as its own piston, in comparison to the version of FIG. 10. That is, the head end portion of plunger 242 includes an O-ring 246 which rides sealingly within a bore 248 defined within the interior of a bobbin 250 which supports winding 240. As in the approach of FIG. 5, the reciprocal motion of plunger 242 actuates a rubber diaphram 252 which defines one endwall portion of bore 248 that is filled with a suitable coupling fluid. Again in the manner of FIG. 5, a pump chamber 254 includes an inlet 256, a check valve 258 and an outlet nipple 260 to enable the pumping action to occur. Care must be taken with this version to avoid overtravel of plunger 242 which might result in adherence to the forward pole face associated with winding 240 and to avoid problems of temperature degradation with the sealing of the plunger within its bore.

One more embodiment is illustrated in FIG. 14. In this case, a plunger 260 reciprocates within a solenoid winding 262, the return stroke again being provided by means of a compression spring 264. Coupled to plunger 260 is a piston 266 slidable within a bore 270 which opens into a cavity 272 one wall of which is defined by a flexible diaphram 274 as in FIG. 5. A pumping chamber 276 has an inlet nipple 278 and an outlet nipple 280 together with an umbrella valve 282 which operates as discussed above again with regard to FIG. 5. This particular version of FIG. 14 has the advantage that only a single solenoid winding is required, while it achieves others of the advantages described previously with regard to the subject matter of FIG. 5.

As has been discussed, certain of the embodiments use a return spring, while others use a solenoid for accomplishing the return of the basic working plunger and/or piston. FIG. 15*a* illustrates in a time-versus-force diagram that which happens in any one of the embodiments which uses a spring for restoring the plunger and thereby creating the suction stroke. The force developed magnetically by the solenoid winding is represented by curve 300. Subtracting losses due to friction and analogous factors, the net force available is shown by curve 302, and the available work for actual pumping is illustrated by the shaded area under curve 302. While the winding is energized to cause pumping, there also is a subtractive spring force as represented by curve 304. When the winding is de-energized, that spring force relaxes as shown by curve 306 and allows the plunger to return to the initial position.

With an approach as represented in FIG. 15(*a*) which includes the use of a physical spring, a desired frequency may be achieved by increasing spring rate and spring preload. In all approaches that involve use of a physical spring, however, careful attention had to be observed in order to obtain a sufficiently high duty cycle, because it generally takes such a spring longer to return the plunger than a single solenoid takes to provide the power stroke. In addition, and as revealed by FIG. 15(*a*), any physical spring function actually is working against the function of the solenoid in its effort to provide pumping, and that leads to the necessity of employing a larger and more costly solenoid winding.

FIG. 15(*b*) pertains to the foregoing embodiments which utilize a push-pull arrangement of two different solenoids. As before, a curve 308 indicates the net work available for creating pressure in order to produce the liquid pulses, while a curve 310*a* represents the force induced by the other, alternatively-energized, solenoid winding. Because neither coil in a push-pull approach need produce a force that opposes action of the other coil, that approach appears to be preferred. Especially at low pulse rates, however, a single coil plus a spring might be more economical.

In all cases, it should be noted that, except for the magnetic structures themselves, either plastics or rubber are desirably employed for all other parts. Direct-current-energized solenoids have been specifically shown. In the alternative, alternating-current solenoids could be employed. That avoids the need for rectifying and also leads to advantages in the avoidance of permanent magnetization. Direct-current solenoids have a number of advantages and, therefore, are preferred. There is no inductive reactance which needs to be considered in the design. Moreover, such inductive reactance changes with air gap sizes, and that inductive reactance must be accomodated by increased size of the winding or windings. Overheating is more likely to result if a plunger is seated against a pole in an alternating-current version. Further, an alternating current solenoid approach at least usually requires laminated steel parts as contrasted with the use of solid materials.

FIG. 16 illustrates a preferred pressure-time curve as measured at the exit from the pumping chamber in any of the units. As indicated, the pressure is rather low over a significant range in the first half of the pumping cycle and yet substantial pulse width is later developed. For oral hygiene appliances, a desired total work per stroke is of the order of a bit under 2.0 pound inches. With inherent losses always present, this seems to require a work from the actuating device of better than 6.0 pound inches.

By using plastics or the like for the principal components exposed to the liquid, perhaps as well as rubber for the valving, there is thorough compatability of the unit in functioning with a supply of liquids other than water, such as salt water, a mouth wash or a medicant. The plastic parts involved are readily capable of being injection-molded out of such standard materials as polyethylene, polypropylene or nylon.

Cost advantage may be obtained in the manner of the making of the solenoid windings. For example, the coils may be made by wrapping aluminum or copper foil, backed by an insulator around the bobbin. By splitting it into different widths, the number of turns on a coil can be varied considerably while using the same amount of material. That approach also allows the obtainment of a variety of resistances as desired, simply by changing the way the ends are joined together by series, parallel or combinations of those.

In the formation of the shells or housings, it is possible to use a plastic impregnated with magnetic material so as to provide both electrical and magnetic surrounding. Such materials can be injection molded with conventional equipment. A secondary benefit of the use of a magnetic plastic is that it also provides a water-tight enclosure for the electrical windings, other electrical components and connections located in the region of the coil(s). In this case, magnetic incapsulation may be improved by surrounding shell 60 with a band 310 of highly-permeable material.

Returning to FIG. 5, the objective in the respective sizing of the coils or windings is to perform the required work in just the time desired, such as one-twentieth of a second. Both windings in FIG. 5 have a shared magnetic path, their mutual configurations being such that their magnetic field polarities oppose each other. Because coil 64, the coil that develops the pressure pulse in the liquid, does not have to overcome any preload induced by the use of a return spring as in some of the alternative embodiments, the size of coil 64 can be smaller than otherwise would result. In addition, the return or suction force of coil 66 is capable of being small. Actually, the length of coil 66 may be considerably less than that of coil 64, approximately equivalent to the length of what would be necessary from using a mechanical spring. All of this results in increased compactness.

The preferred embodiment of FIG. 5 exhibits what appear to be lesser power requirements as compared with the other embodiments, allows the use of a less-diameter wire on the windings and a lesser magnetic structure. Of course, all of that results in cost savings as well as in lighter weight. It will be noted that all moving parts are enclosed within the overall pump assembly, lending to easy encapsulation for satisfying requirements as to insulation and protection of the user. Because there are no springs involved in the version of FIG. 5, the assembly of that concept is simplified over others of the alternatives which may require installation and even preloading of springs.

In a completed unit produced in accordance with the version of FIG. 5, the pressure developed in the outletted pulses was between 90 and 100 psi while pumping was occurring, rising to about 160 psi when that delivery was plugged. Under those conditions, the flow rate was at 400 milliliters per minute at the pressure of 90 psi and the rate of about 1200 pulses per minute. The circuitry exhibited in FIG. 4 showed good frequency stability and it appeared that there was insufficient heating during operation of the windings to be of concern.

It will be observed that printed circuit board 44 should be hermetically encapsulated for protection against the effects of moisture, and individually discrete components as conventionally mounted thereon have not been shown in the drawings. Of course, the arrangement of those components is conventionally made in view of the exact circuitry and the size and shape of the different components employed in a given instance. Analogously, panel 38 has been only somewhat-schematically represented as containing eight touch button areas. Actually, the circuitry of FIG. 4 may be actuated by including only a single on-off switch of any sort.

It is contemplated, however, that more sophisticated circuitry may be included in order to accomodate further control of the force exerted upon the plunger in adjustment of any one or more of the rate at which the liquid pulses occur, the volume of flow of the liquid and the pressure in the pulses as delivered. In view of the state of the art, this suggests the employment of a programmed microprocessor or of a dedicated chip to provide the additional controls that may be desired. One approach in that direction is shown in FIG. 6. Here, the alternating-current power externally available at either 50 or 60 hertz is supplied to terminals 320 and 322 which lead to a bridge rectifier 324. One side of bridge 324 is connected in parallel to one end of each of winding 62 and 64, while its other side is returned to a common ground 326. A voltage divider, composed of resistors 328 and 330, connected in series across the output of rectifier 324, supplies from its center-tap an actuating potential to a terminal 332 of a dedicated chip 334, in order to enable chip 334 to sense the application of power. Ground 326 is connected to a terminal 336 while a positive operating potential is applied to a terminal 338 through a current limiting resistor 340 and a diode 342, in order to complete the supply of operating power to chip 334. A lead 344 connects terminal 338 over a capacitor 346 to a temperature-sensing element 348 back to ground in order to supply a temperature input signal to a terminal 350 of chip 334. Sensor 348 is located within the winding assembly in order to disable operation of chip 334 upon the occurance of excessive heating of windings 62 and/or 64.

An operation frequency control terminal 352 leads through an adjustable resistor 354 to terminal 338. An on/off terminal 356 is connected to an on-off switch 358 back to ground. Respective test points are connected to terminals 360, 361, 362 and 363 in order to permit the determination of the corresponding different functions, such as the oscillator output, the 50 or 60 hertz output, the 110 or 220 volt operating output waveform and, in this case, a twenty-hertz operating frequency.

Windings 62 and 64 are returned to ground through respective SCR's 366 and 368, the corresponding gates of which are connected to operating output terminals 370 and 372. Adjustment of resistor 354 enables a variation of duty cycle of the driving pulses applied to windings 62 and 64. The signal applied to terminal 332 enables chip 334 to sense the occurrance of a zero crossing, providing timing. Of course, switch 358 enables the determination of when switching is to occur.

FIG. 6*a* illustrates a basic timing diagram. The output from bridge 324 is shown by waveform 374 for either 50 or 60 hertz operation and for either 110 or 220 volts supply. Waveforms 376 and 378 respectively illustrate the output signals correspondingly fed to SCR's 366 and 368, while waveform 380 illustrates the twenty-hertz operation, corresponding to the pulse rate, as ultimately produced; all of waveforms 376–380 apply to 50 hertz operation. For 60 hertz operation, similar waveforms are depicted at 382, 384 and 386 corresponding to the output at terminals 370, 372 and 363.

Given the timing diagram of FIG. 6*a* and the basic control approach of FIG. 6, it is apparent that the ultimate driving pulses fed respectively to SCR's 366 and 368, and thus to windings 62 and 64, enable control of the rate at which windings 62 and 64 are energized, as well as that the width of the driving pulse affects both flow rate and ultimate pressure in itself. Such controls of pulse width, pulse spacing and pulse rate are conventional. In any case, the particular circuitry selected may take a variety of different specific forms. The illustrative circuits of FIGS. 4 and 6 are only representative.

As will be observed, some embodiments appear to be better than others for achieving the ultimate of utility in the field of concern. Those embodiments which utilize fluid coupling between a reciprocating mechanical element and the pumping diaphram enable the attainment of longer life in such a diaphram element. The employment of magnetic action for both the pumping and return strokes is an asset in not only reducing cost but also in achieving economy in manufacture.

In any version, there is a decided improvement over the use of a rotary electric motor for developing the power needed for pumping, in terms of both cost and in offering flexibility of design and more economical use of interior space. Further, and as explained with regard to FIG. 6, all of the present approaches adapt themselves well to the incorporation of low-cost electronic circuitry which offers the capability of control over the characteristics of the delivered pulses in a manner heretofore never before achieved. Yet, overall size can be even smaller than before.

While particular embodiments of the invention have been shown and described, and numerous modifications and changes have been mentioned, it will be obvious to those skilled in the art that further changes and modifications may be made without departing from the invention in its broader aspects. Therefore, the aim in the appended claims is to cover all such changes and modifications as fall within the true spirit and scope of that which is patentable.

We claim:

1. A hygienic appliance combination comprising:

a housing;

a source of liquid associated with said housing;

delivery means coupled to said housing for launching pulses of said liquid to a point of impact;

and a pump located within said housing and coupled to accept said liquid and provide pulses of said liquid into said delivery means, said pump including:

enveloping means defining an elongated central bore of predetermined length;

at least one solenoid winding positioned to deliver magnetic flux into the interior of said bore;

a plunger of magnetic material sized to slide within said bore and of a length less than said predetermined length;

a chamber defined in said pump;

means for inletting liquid from said source into said chamber;

means for outletting liquid from said chamber into said delivery means;

check valve means effectively disposed in the path of flow of said liquid for permitting flow of said liquid at least primarily in the direction from said source, through said chamber and out of said delivery means;

reciprocating means coupled into said chamber for alternately effecting the drawing of said liquid into said chamber and propelling said liquid from said chamber through said outletting means into said delivery means;

means disposed within said housing and adjacent to said chamber for indirectly slaving movement of said reciprocating means to movement of said plunger;

means for cyclically energizing said one winding to move said plunger and said reciprocating means each in a given direction;

and means for urging said plunger and said reciprocating means each in a return direction opposite said given direction.

2. A combination as defined in claim 1 in which said urging means is a second solenoid winding positioned to deliver magnetic flux into the interior of said bore with a polarity opposite that flux delivered by said at least one winding, the amount of said flux delivered by said second winding being substantially less than that delivered by said at least one winding, and which further includes means for cyclically energizing said second winding in alternation to energizing of said at least one winding.

3. A combination as defined in claim 1 in which said reciprocating means defines one wall of said chamber.

4. A combination as defined in claim 3 in which said reciprocating means is a flexible diaphragm that defines said one wall and flexes in response to movement of said plunger.

5. A combination as defined in claim 4 in which said chamber is defined within said diaphragm.

6. A combination as defined in claim 1 in which said reciprocating means is effectively fluid coupled to said plunger.

7. A combination as defined in claim 1 in which there is defined within said housing a second bore interposed between said plunger and said reciprocating means, and in which said slaving means further includes a piston slidable within said second bore and means for coupling said piston between said plunger and said reciprocating means.

8. A combination as defined in claim 7 in which said piston includes said reciprocating means.

9. A combination as defined in claim 7 in which said pump includes means for fluid coupling of said piston to said reciprocating means.

10. A combination as defined in claim 1 in which said plunger includes an end face which actuatingly engages said slaving means.

11. A combination as defined in claim 1 in which said urging means includes a spring, the force exerted by said spring upon said plunger being substantially less than the force exerted upon said plunger in response to energization of said at least one solenoid winding.

12. A combination as defined in claim 1 in which said reciprocating means includes a spiraled bellows along one of the interior and exterior of which is defined a path through which said liquid flows from said inletting means to said outletting means.

13. A combination as defined in claim 1 in which said plunger includes a piston head that coacts with said bore to develop a force for driving said reciprocating means.

14. A combination as defined in claim 13 in which said piston head is fluid coupled to said reciprocating means.

15. A combination as defined in claim 1 which further includes means for controlling the force exerted upon said plunger by at least one of said flux and said urging means in adjustment of at least one of the rate at which said pulses occur, the volume of flow of said liquid and the pressure in said pulses as delivered.

16. A hygienic appliance combination comprising:

a housing;

a source of liquid associated with said housing;

delivery means coupled to said housing for launching pulses of said liquid to a point of impact;

and a pump located within said housing and coupled to accept said liquid and provide pulses of said liquid into said delivery means, said pump including;

enveloping means defining an elongated central bore of predetermined length;

at least one solenoid winding positioned to deliver magnetic flux into the interior of said bore;

a plunger of magnetic material sized to slide within said bore and of a length less than said predetermined length;

a chamber defined in said pump;

means for inletting liquid from said source into said chamber;

means for outletting liquid from said chamber into said delivery means;

check valve means effectively disposed in the path of flow of said liquid for permitting flow of said liquid at least primarily in the direction from said source, through said chamber and out of said delivery means;

reciprocating means coupled into said chamber for alternately effecting the drawing of said liquid into said chamber and propelling said liquid from said chamber through said outletting means into said delivery means;

means for slaving movement of said reciprocating means to movement of said plunger;

means for cyclically energizing said one winding to move said plunger and said reciprocating means each in a given direction;

means for urging said plunger and said reciprocating means each in a return direction opposite said given direction;

said reciprocating means defining one wall of said chamber and being a flexible diaphram that defines said one wall and flexes in response to movement of said plunger with said chamber being defined within said diaphram and said fluid being inletted to said chamber through the interior of said plunger.

17. For use with an appliance that has a source of liquid and means for delivering said liquid for use, a pump comprising:

a shell within which is defined an elongate bore of predetermined length;

means coupled to said shell for respectively inletting and outletting said liquid into and out of said shell;

a plunger of magnetic material sized to slide within said bore and having a length less than said predetermined length;

an effective pair of solenoid windings each positioned to deliver magnetic flux into the interior of said bore;

means for energizing individual ones of said windings alternatively to induce movement of said plunger in reciprocation;

means defined within said shell that establishes a second bore;

a piston sealingly disposed within said second bore for movement slidingly therein;

means for coupling said piston for movement in slaving relationship to said plunger;

a chamber effectively defined in said shell;

means for inletting said liquid into said chamber;

means for outletting said liquid from said chamber;

check valve means effectively disposed in the path of flow of said liquid for permitting flow of said liquid only in the direction from said inletting means, through said chamber and out of said outletting means;

a diaphragm effectively defining a portion of the boundary of said chamber, flexure of said diaphragm in alternate directions respectively effecting the drawing of said liquid into said chamber and propelling said liquid from said chamber;

a cavity defined within said shell and into which said piston projects as a portion of the wall thereof with said diaphragm forming another portion of said wall;

and a fluid contained within said cavity for coupling movement of said piston in slaving relationship to effect flexure of said diaphragm.

18. A pump as defined in claim 17 in which said piston is rigidly connected to said plunger.

19. A pump as defined in claim 17 in which the one of said windings which effects movement of said plunger away from said diaphragm induces substantially less flux into said plunger than that flux induced therein by the other of said windings.

20. A pump as defined in claim 17 which further includes means for controlling the force exerted upon said plunger by the flux from one or both of said windings in adjustment of one or more of the rate at which said pulses occur, the volume of flow of said liquid and the pressure in said pulses as delivered.

* * * * *